US005871635A

United States Patent [19]

Gupta et al.

[11] Patent Number: 5,871,635

[45] Date of Patent: Feb. 16, 1999

[54] HYDROPROCESSING OF PETROLEUM FRACTIONS WITH A DUAL CATALYST SYSTEM

[75] Inventors: Ramesh Gupta, Berkeley Heights; Edward S. Ellis, Basking Ridge, both of N.J.; William Ernest Lewis, Baton Rouge, La.

[73] Assignee: Exxon Research and Engineering Company, Florham Park, N.J.

[21] Appl. No.: 753,857

[22] Filed: Dec. 3, 1996

Related U.S. Application Data

[63] Continuation-in-part of Ser. No. 438,006, May 9, 1995, abandoned.

[51] Int. Cl.[6] ..... C10G 45/00

[52] U.S. Cl. ..... 208/89; 208/61; 208/108; 208/213; 208/216 R; 208/217; 208/251 H; 208/254 H; 208/149; 208/113

[58] Field of Search ..... 208/213, 215, 208/216 R, 217, 251 H, 254 H, 143, 149, 108, 111, 113, 163, 89, 61

[56] References Cited

U.S. PATENT DOCUMENTS

| | | | |
|---|---|---|---|
| 3,331,769 | 7/1967 | Gatsis | 208/210 |
| 3,635,943 | 1/1972 | Stewart | 208/157 |
| 3,730,878 | 5/1973 | Pollitzer | 208/143 |
| 3,767,569 | 10/1973 | Mayer et al. | 208/211 |
| 3,975,259 | 8/1976 | Doelp | 208/216 R |
| 4,376,037 | 3/1983 | Dahlberg et al. | 208/111 |
| 4,389,301 | 6/1983 | Dahlberg et al. | 208/149 |
| 4,604,189 | 8/1986 | Derbyshire et al. | 208/111 |
| 4,863,887 | 9/1989 | Ohtake et al. | 208/216 R |
| 4,952,306 | 8/1990 | Sawyer et al. | 208/216 R |
| 5,008,001 | 4/1991 | Kitamura et al. | 208/143 |
| 5,037,532 | 8/1991 | Winter, Jr. et al. | 208/143 |
| 5,108,581 | 4/1992 | Aldridge et al. | 208/111 |
| 5,318,693 | 6/1994 | Davis et al. | 208/113 |
| 5,395,511 | 3/1995 | Kubo et al. | 208/111 |

*Primary Examiner*—Walter D. Griffin
*Attorney, Agent, or Firm*—Roy J. Ott

[57] ABSTRACT

Hydrocarbonaceous feedstocks admixed with a flow-through catalyst and hydrogen are hydroprocessed in a hydroprocessing reactor containing a captive hydroprocessing catalyst. The flow-through catalyst is continually withdrawn with the hydroprocessed feed from the hydroprocessing reactor. The flow-through catalyst may be an FCC, hydrocracking, isomerization or ring-opening catalyst. In a preferred embodiment, the captive hydroprocessing catalyst contains Co, Ni and/or Mo on an alumina base and the flow-through catalyst is an FCC zeolitic catalyst which is withdrawn with the hydroprocessed feed from the hydroprocessing reactor and then sent to an FCC unit.

10 Claims, 2 Drawing Sheets

HYDROPROCESSING OF PETROLEUM FRACTIONS WITH A DUAL CATALYST SYSTEM

CROSS REFERENCE TO RELATED APPLICATIONS

This is a continuation-in-part application of U.S. patent application Ser. No. 08/438,006, filed May 9, 1995, now abandoned.

FIELD OF THE INVENTION

This invention relates to the hydroprocessing of hydrocarbons. In particular, it relates to a process wherein a petroleum fraction containing a flow-through catalyst for promoting reactions such as hydrogenation, cracking, isomerization, ring opening, etc. is contacted with hydrogen under hydroprocessing conditions in a hydroprocessing reactor containing a captive hydroprocessing catalyst.

BACKGROUND OF THE INVENTION

Hydroprocessing processes have been used to improve poor quality petroleum derived feeds for catalytic cracking reactions. For example, hydrotreating processes have been used to improve resids, vacuum gas oils, coker gas oils, middle distillates and recycle streams from the fluid catalytic cracking (FCC) unit. These processes generally use a catalyst to remove nitrogen and/or sulfur and to at least partially hydrogenate multi-ring aromatics or naphtheno-aromatics to hydrogen enriched naphtheno-aromatics and naphthenes which are more easily cracked in the FCC unit with less coke and tar make.

It is known that heavy hydrocarbonaceous fractions of petroleum can be more effectively hydrotreated if mild hydrocracking also takes place in the hydrotreating reactor. Physical mixtures of catalysts are known to impart separate cracking functionality and hydrogenation functionality. In theory, (a) mild cracking would open naphthene rings which would not dehydrogenate and revert back to the aromatic structure and (b) the multi-ring aromatics or naphtheno-aromatics would be hydrogenated to render them more easily cracked in FCC with less coke and tar make. Unfortunately, these dual catalyst systems have not proven to be commercially feasible because the catalysts which promote cracking activity, such as zeolite-containing catalysts and other solids with acidic sites, deactivate rapidly due to the presence of basic nitrogen and other impurities present in the hydrotreating reactor.

It is therefore an object of the invention to provide a hydroprocessing process utilizing a dual catalyst system including a hydroprocessing catalyst and a second catalyst which enhances the performance of the hydroprocessing catalyst. It is a further object of the invention to provide a hydroprocessing process utilizing a hydroprocessing reactor containing a dual catalyst system including a hydroprocessing catalyst and a second catalyst which enhances the performance of the hydroprocessing catalyst wherein the second catalyst is not materially deactivated in the hydroprocessing reactor.

SUMMARY OF THE INVENTION

In a process for hydroprocessing a hydrocarbon feed which has not been previously hydroprocessed by contact with hydrogen in a hydroprocessing reactor containing a captive hydroprocessing catalyst, the improvement which comprises:

(a) introducing into the hydroprocessing reactor the hydrocarbon feed and a flow-through catalyst which has acidic sites and enhances the performance of the hydroprocessing catalyst by promoting hydrocracking, or isomerization, or ring opening, or combinations thereof of the hydrocarbon feed;

(b) hydroprocessing the hydrocarbon feed in the hydroprocessing reactor under hydroprocessing conditions which do not materially deactivate the flow-through catalyst; and (c) recovering a mixture of hydroprocessed feed and the flow-through catalyst from the hydroprocessing reactor.

In a preferred embodiment of the invention, the flow-through catalyst is an FCC catalyst.

In a particular embodiment of the invention, there is provided in a process for hydroprocessing a heavy hydrocarbonaceous feed which has not been previously hydroprocessed and which contains multi-ring aromatics and/or naphtheno-aromatics by contacting the feed with hydrogen in a hydroprocessing reactor containing a captive hydroprocessing catalyst, the improvement which comprises:

(a) introducing into the hydroprocessing reactor the feed and a flow-through FCC catalyst having acidic sites;

(b) hydrotreating and cracking the feed in the hydroprocessing reactor under conditions whereby naphthene rings are cracked open and multi-ring aromatics and/or naphtheno-aromatics are hydrogenated;

(c) recovering a mixture of hydroprocessed feed and flow-through FCC catalyst from the hydrotreating reactor; and (d) introducing the hydroprocessed feed and flow-through FCC catalyst into an FCC system.

DETAILED DESCRIPTION OF THE INVENTION

Figure 1:
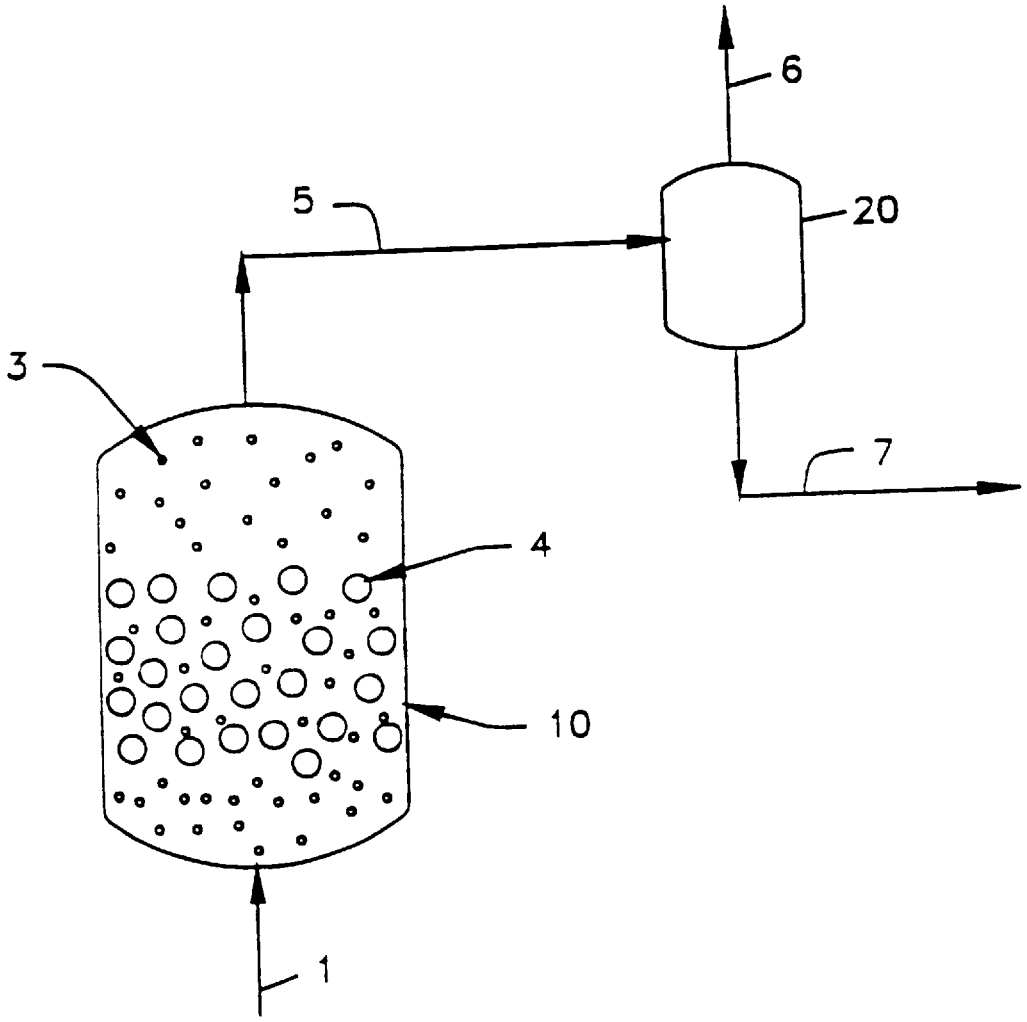
FIG. 1 is a schematic representation of a preferred embodiment of the invention.

The hydroprocessing of petroleum fractions by contact with hydrogen in the presence of a hydroprocessing catalyst to remove impurities such as nitrogen, sulfur, oxygen, metals and halides can be improved by utilizing a second catalyst in the hydroprocessing zone. The second catalyst enhances the performance of the hydroprocessing catalyst by promoting reactions which convert the feed into molecular structures which are more amenable to hydrogenation or subsequent processing. For example, the second catalyst may be an acidic catalyst which promotes ring-opening cracking so that hydrogenated naphthene rings cannot dehydrogenate and revert back to the aromatic structure.

It has been found in accordance with the invention that the second catalyst must be in a particular form so that it may be added to and removed from the hydrotreating reactor to avoid its substantial deactivation. The second catalyst is added to the hydroprocessing reactor as a flow-through catalyst which is removed from the hydroprocessing reactor in admixture with the hydrocarbon effluent withdrawn from the hydroprocessing reactor. Adding the second catalyst as a flow-through catalyst avoids its deactivation and minimizes undesirable side reactions.

The invention can be more readily understood by reference to the preferred embodiment depicted in the Figure. Referring to the Figure showing a single stage process for hydroprocessing a heavy hydrocarbonaceous oil, a petroleum feed, such as a vacuum gas oil, in admixture with a conventional FCC catalyst (fresh and/or regenerated), such as zeolite Y embedded in a silica alumina matrix, is introduced along with hydrogen into hydroprocessing reactor 10 via line 1. The FCC catalyst is of sufficiently small particle size, i.e., a preferred diameter particle size in the range of 1 to 500 microns, so as to flow with the feed to and the product from hydroprocessing reactor 10. Hence the term "flow-through" catalyst.

Hydroprocessing reactor 10 may be, for example, a fixed bed, a slurry or ebullating bed type reactor. Hydroprocessing reactor 10 contains a captive, relatively large size, i.e., a preferred diameter particle size in the range of 0.5 to 5.0 mm, conventional hydrotreating catalyst, such as a catalyst comprising Ni and Mo or Co and Mo on an alumina base.

Within hydroprocessing reactor 10, the flow-through FCC catalyst is shown as a relatively small size and designated as flow-through catalyst 3 and the hydrotreating catalyst is shown as a relatively large size and designated as catalyst 4. Hydroprocessing reactor 10 is maintained at typical hydroprocessing conditions such as a temperature in the range of 200°–480° C., e.g., 300° C., and a pressure in the range of 690–21,000 kPa, e.g., 6,000 kPa. The amount of hydrogen added may be about 500–5000, e.g., 2,000, standard cubic feet (about 90–900 $Nm^3/m^3$) per barrel of feed. The amount of flow-through FCC catalyst may be about 0.25 to 30, e.g., 10, kg per barrel of feed, depending on reactor hydrodynamics and catalyst activity of the flow-through catalyst.

The effluent oil product, flow-through FCC catalyst and entrained hydrogen are withdrawn from hydroprocessing reactor 10 via line 5 and introduced into separator 20 from which hydrogen is withdrawn via line 6 and oil and flow-through FCC catalyst is withdrawn via line 7 for delivery to an FCC reactor system (not shown). The typical residence time, i.e., the average amount of time between when the flow-through catalyst enters and leaves the hydroprocessing reactor, will range widely, e.g., from about 2 minutes to 8 hours or more, typically 10 minutes to 4 hours (e.g., 30 minutes) depending on how refractory the feed is and how much hydroprocessing is desired. The flow-through catalyst is not separated from hydroprocessed oil product from the hydrotreating reactor and the hydroprocessed oil in admixture with the flow-through catalyst becomes feed for the FCC. Alternately, the hydroprocessed oil and flow-through catalyst stream is not sent to a FCC reactor, but the flow-through catalyst is separated from the oil using such means as filtration, decanting or centrifuge.

Hydrocarbon Feedstocks

The hydrocarbon feedstocks which may be hydroprocessed include hydrocarbon fractions having an initial boiling point of at least about 50° C., more preferably at least about 100° C., usually above 200° C. As appreciated by those of ordinary skill in the art, such hydrocarbon fractions are difficult to precisely define by initial boiling point since there is some degree of variability in large commercial processes. Hydrocarbon fractions which are included in this range, however, are understood to include naphthas, middle distillates, gas oils, thermal oils, residual oils, cycle stocks, topped and whole crudes, tar sand oils, shale oils, synthetic fuels, heavy hydrocarbon fractions derived from coking processes, tar, pitches, asphalts and the like. The invention is not limited to conventional refinery petroleum streams, but is also applicable to petrochemical and chemical process streams.

Hydroprocessing Catalyst

The hydroprocessing catalyst employed in the hydroprocessing reactor may be any conventional hydroprocessing catalyst suitable for aromatic saturation, desulfurization, denitrogenation or any combination thereof Preferably, the hydroprocessing catalyst is comprised of at least one Group VIII metal and a Group VI metal on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of *Advanced Inorganic Chemistry,* 2nd Edition 1966, Interscience Publishers, by Cotton and Wilkenson.

The Group VIII metal is preferably present in an amount ranging from 2–20 wt %, preferably 4–12 wt %. Preferred Group VIII metals include Co, Ni, and Fe, with Co and Ni being most preferred. The preferred Group VI metals are Mo or W which are present in an amount ranging from 5–50 wt %, preferably 10–40 wt %, and more preferably from 20–30 wt %.

All metals weight percents given are on support. The term "on support" means that the percents are based on the weight of the support. For example, if a support weights 100 g, then 20 wt % Group VIII metal means that 20 g of the Group VIII metal is on the support.

Any suitable inorganic oxide support material may be used for the hydroprocessing catalyst of the present invention. Preferred are alumina and silica-alumina, including crystalline alumino-silicate such as zeolite. More preferred is alumina. The silica content of the silica-alumina support can be from 2–30 wt %, preferably 3–20 wt %, more preferably 5–19 wt %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 A, preferably, 70–150 A, and a surface area from 50–450 $m^2/g$. The particle size of the hydroprocessing catalyst will typically vary from about 0.2 to 5 millimeters, more preferably from about 0.5 to 3.0 millimeters.

Flow-through Catalyst

The flow-through catalyst enhances the performance of the hydroprocessing catalyst by promoting reactions which convert the feed into preferred molecular structures so that reactions such as hydrogenation, denitrification, desulfurization, etc. more readily occur in the hydroprocessing reactor. The flow-through catalyst will also increase the conversion of the heavy oils to lower boiling materials in the hydroprocessing reactor. The flow-through catalyst may also result in oil products from the hydroprocessing reactor which are more easily converted in subsequent reactors such as an FCC reactor. The flow-through catalyst will typically be a FCC or hydrocracking catalyst, an isomerization catalyst or a catalyst which promotes organic ring opening.

The flow-through catalyst will also have a particle size sufficiently small so that it may flow through the hydroprocessing reactor without plugging. For example, in the case of a fixed bed hydroprocessing reactor containing ⅛ inch (0.3175 cm) diameter hydroprocessing catalyst, a flow-through catalyst having a particle size diameter as large as 350 microns may be employed without plugging the fixed bed. A typical average particle diameter for the flow-through catalyst may be 60 microns with a hydroprocessing catalyst having an average particle diameter of 0.3175 cm. Appropriate catalyst particle sizes will be apparent to those skilled in the art.

In addition to regulating plugging or fouling by controlling the particle size of the flow-through catalyst and hydroprocessing catalyst, the flow-through catalyst may be injected at various levels of the hydroprocessing reactor to protect against plugging. For example, the flow-through catalyst may be injected in a second bed instead of the top bed which is more prone to fouling due to the deposition of polymers, scale or deposits. The addition of the flow-through catalyst, such as an FCC catalyst, to the second bed/stage of a hydroprocessing reactor may have other beneficial effects. The bulk of the highly basic nitrogen species and metals which would otherwise poison an acidic catalyst can be removed or converted to $NH_3$ by the first hydroprocessing stage. Introduction of the flow-through catalyst downstream of the initial bed/stages reduces potential deactivation of the catalyst.

The flow-through catalyst of this invention may be a cracking catalyst, which can be any catalyst that is typically used to catalytically "crack" hydrocarbons. It is preferred that the cracking catalyst comprise a crystalline tetrahedral framework oxide component. This component is used to catalyze the breakdown of primary products from the catalytic cracking reaction into clean products such as naphtha for fuels and olefins for chemical feedstocks. Preferably, the crystalline tetrahedral framework oxide component is selected from the group consisting of zeolites, tetrahedral aluminophosphates (ALPOs) and tetrahedral silicoaluminophosphates (SAPOs). More preferably, the crystalline framework oxide component is a zeolite.

Zeolites which can be employed in accordance with this invention include both natural and synthetic zeolites. These zeolites include gmelinite, chabazite, dachiardite, clinoptilolite, faujasite, heulandite, analcite, levynite, erionite, sodalite, cancrinite, nepheline, lazurite, scolecite, natrolite, ofretite, mesolite, mordenite, brewsterite, and ferrierite. Included among the synthetic zeolites are zeolites X, Y, A, L, ZK-4, ZK-5, B, E, F, H, J, M, Q, T, W, Z, alpha and beta, ZSM-types and omega. Zeolite Y and ultra stable zeolite Y are particularly preferred.

In general, aluminosilicate zeolites are effectively used in this invention. However, the aluminum as well as the silicon component can be substituted for other framework components. For example, the aluminum portion can be replaced by boron, gallium, titanium or trivalent metal compositions which are heavier than aluminum. Germanium can be used to replace the silicon portion.

The cracking catalyst used in this invention can further comprise an active porous inorganic oxide catalyst framework component and an inert catalyst framework component. Preferably, each component of the catalyst is held together by attachment with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM #D3907-8). Compounds such as those disclosed in Greensfelder, B. S., et al., *Industrial and Engineering Chemisty,* pp. 2573–83, November 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays as well as α-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as α-alumina, β-alumina, γ-alumina, δ-alumina, ϵ-alumina, κ-Alumina, and ρ-alumina can be employed. Preferably, the alumina species is an aluminum trihydroxide such as gibbsite, bayerite, nordstrandite, or doyelite.

The flow-through catalyst also includes those catalysts which have acidic sites, which are prone to deactivation due to the presence of basic nitrogen and other impurities present in the hydroprocessing reactor and which promotes reactions such as hydrocracking, isomerization and ring opening.

The flow-through catalyst includes a wide variety of conventional hydrocracking catalysts. These include those catalysts containing Group VIII metals such as noble metals, Ni, Co, etc., and/or Group VI metals such as Mo and W on a carrier material which may be either amorphous or zeolitic in nature. The preferred noble metals include platinum and palladium present in amounts of 0.1% to about 4.0% by weight. Whether amorphous or zeolitic, preferred carrier materials include both alumina and silica. With the relatively heavier hydrocarbonaceous feedstocks, it is often more appropriate to utilize a hydrocracking catalyst founded upon a crystalline aluminosilicate, or zeolitic molecular sieve. Such zeolitic material includes mordenite, Type X or Type Y faujasite. However, the zeolitic material may be included within an amorphous matrix such as alumina, silica and mixtures thereof.

Hydroprocessing

As used herein, hydroprocessing includes hydrogenation, mild hydrocracking, denitrification, desulfurization, isomerization, demetalization and the like. As is known by those of skill in the art, the degree of hydroprocessing can be controlled through proper selection of catalyst as well as by optimizing operation conditions.

It is particularly desirable in this invention that the hydroprocessing step sufficiently saturate some of the aromatic rings to more easily form crackable naphthene rings. It is also desirable that the hydroprocessing step convert unsaturated hydrocarbons such as olefins and diolefins to paraffins using the hydroprocessing catalyst. Objectionable elements can also be removed by the hydroprocessing reaction. These elements include sulfur, nitrogen, oxygen, halides, and certain metals.

The hydroprocessing step of the invention is performed under standard hydroprocessing conditions. Preferably, the reaction is performed at a temperature of 200°–480° C., more preferably 260°–430° C. The reaction pressure is preferably 690–21,000 kPa, more preferably 2760–13,800 kPa. The hourly space velocity is preferably 0.1–5.0 V/V/Hr, more preferably 0.3–2.0 V/V/Hr, where V/V./Hr is defined as the volume of oil per hour per volume of reactor. The hydrogen containing gas is preferably added to establish a hydrogen charge rate of 90–2700 $Sm^3/m^3$ per barrel (500–15,000 SCF/B), more preferably 180–890 $Sm^3/m^3$ per barrel (1,000–5,000 SCF/B).

The invention will be further understood by reference to the following Example, which includes a preferred embodiment of the invention.

EXAMPLE

A Kuwait VGO feed having the properties shown in the Table below was separately processed in a hydroprocessing reactor containing equal amounts of either Catalyst A, Catalyst B or Catalyst C. Catalyst A is a hydrotreating catalyst consisting of 3.0 weight % NiO and 18 weight % $MoO_3$ on an alumina support. Catalyst B consists of a physical mixture of 75 volume % Catalyst A and 25 volume % of a FCC cracking catalyst consisting of 11 weight percent rare earth Y zeolite embedded in a silica alumina matrix. Catalyst C consists of a physical mixture of 50 volume % Catalyst A and 50 volume percent of the FCC catalyst of Catalyst B. The conditions employed in the three runs were 10,000 SCF/BBL hydrogen and start-of-run conditions of 1500 psig, 0.5 V/Hour/V and 730° F. After 44 hours on oil, the space velocity was decreased to 0.24 V/Hour/V. The pressure was decreased to 1000 psig after 275 hours on oil and the temperature was increased to 740° F. after 300 hours on oil, to 750° F. after 325 hours on oil, to 760° F. after 375 hours on oil and 770° F. after 475 hours on oil. The 570° F.+ conversion results are shown in FIG. 2.

TABLE

| | Kuwait VGO Feedstock |
|---|---|
| Inspections | |
| Gravity, °API | 21.1 |
| Nitrogen, wppm | 1112 |
| Sulfur, wt. % | 2.85 |
| Con. Carbon, wt. % | 0.15 |
| Distillation, D-1160, 1 mm | |
| Initial, °F. | 778 |
| 10% | 833 |
| 50% | 883 |
| 90% | 963 |

Figure 2:
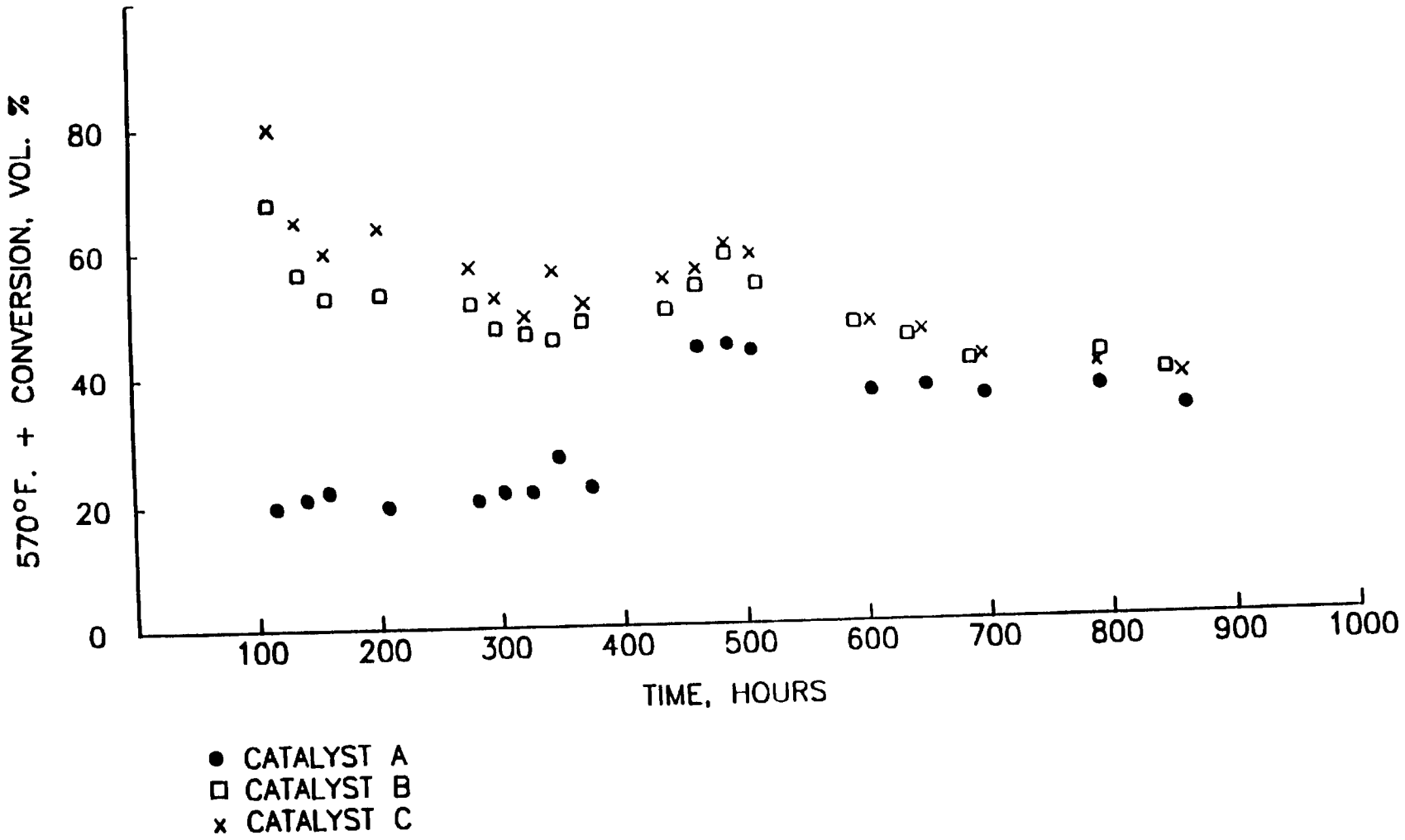
FIG. 2 is a plot of comparative data obtained from the hydroprocessing of a petroleum feed in the presence of hydrogen and a hydrogenation catalyst or a physical mixture of the hydrogenation catalyst and an acidic FCC catalyst.

The results shown in FIG. 2 demonstrate that acidic cracking catalysts have sufficient short-term resistance to deactivation in the presence of basic nitrogen compounds and other impurities resulting from the copresence of hydrogenation catalysts which promote the denitrification and desulfurization of heavy petroleum feeds. The results further demonstrate that the presence of cracking catalyst with a hydrotreating (hydrogenation, denitrification, desulfurization, etc.) catalyst in the hydroprocessing reactor results in improved performance.

What is claimed is:

1. In a process for hydroprocessing a hydrocarbon feed which has not been previously hydroprocessed by contact with hydrogen in a hydroprocessing reactor, the improvement which comprises:

(a) introducing into the hydroprocessing reactor the hydrocarbon feed and a flow-through catalyst which has acidic sites and enhances the performance of the hydroprocessing catalyst by promoting hydrocracking, or isomerization, or ring opening, or combinations thereof of the feed;

(b) hydrotreating the hydrocarbon feed in the hydroprocessing reactor containing a captive hydroprocessing catalyst under hydroprocessing conditions which do not materially deactivate the flow-through catalyst;

(c) recovering a mixture of hydroprocessed feed and the flow-through catalyst from the hydroprocessing reactor; and (d) delivering and introducing the mixture of hydroprocessed feed and the flow-through catalyst from the hydroprocessing reactor to an FCC system.

2. In the process of claim 1, the improvement wherein the hydroprocessing catalyst is comprised of at least one Group VIII metal and a Group VI metal on an alumina or alumina-silica support.

3. In the process of claim 2, the improvement wherein the flow-through catalyst is a catalyst selected from the group consisting of FCC catalysts, hydrocracking catalysts, isomerization catalysts and ring-opening catalysts.

4. In the process of claim 3, the improvement wherein the flow-through catalyst is an FCC zeolitic catalyst and the feed is a heavy hydrocarbonaceous oil feed.

5. In the process of claim 4, the improvement wherein the hydroprocessing catalyst is comprised of Ni and Mo or Co and Mo or Ni and W on an alumina or silica-alumina support.

6. In a one-stage process for hydroprocessing a heavy hydrocarbonaceous feed containing multi-ring aromatics and/or naphtheno-aromatics by contact with hydrogen in a hydroprocessing reactor containing a captive hydroprocessing catalyst, the improvement which comprises:

(a) introducing the feed and a flow-through FCC zeolitic catalyst into the hydroprocessing reactor;

(b) hydrotreating and cracking the feed in the hydroprocessing reactor under conditions whereby naphthene rings are cracked open and multi-ring aromatics and/or naphtheno-aromatics are hydrogenated;

(c) recovering a mixture of hydroprocessed feed and flow-through FCC catalyst from the hydroprocessing reactor; and (d) introducing the hydroprocessed feed and flow-through FCC catalyst into an FCC system.

7. In the process of claim 6, the improvement wherein the flow-through FCC catalyst has a particle size diameter less than 350 microns and comprises ultra stable zeolite Y embedded in a silica alumina matrix.

8. In the process of claim 7, the improvement wherein the hydroprocessing catalyst has a particle size diameter in the range of about 0.5 to 3.0 mm and comprises an alumina or silica-alumina support containing a metal selected from the group consisting of Co, Ni, Mo, W and mixtures thereof.

9. In the process of claim 8, the improvement wherein the hydroprocessing reactor is a slurry or a fixed bed reactor.

10. In the process of claim 9, the improvement wherein the flow-through FCC catalyst has a particle size diameter less than 350 microns and comprises ultra stable zeolite Y embedded in a silica alumina matrix and the hydroprocessing catalyst has a particle size diameter in the range of about 0.5 to 3.0 mm and comprises an alumina support containing a metal selected from the group consisting of Co, Ni, Mo, W, and mixtures thereof.

* * * * *